United States Patent [19]

Van Ginkel et al.

[11] Patent Number: 4,464,882

[45] Date of Patent: Aug. 14, 1984

[54] DEVICE FOR PACKING A FOWL

[75] Inventors: Mannes Van Ginkel, Barneveld; Kornelis Van 'T Slot, Uddel, both of Netherlands

[73] Assignee: Moba Holdings, Barneveld B.V., Netherlands

[21] Appl. No.: 377,046

[22] Filed: May 11, 1982

[30] Foreign Application Priority Data

May 21, 1981 [NL] Netherlands ..... 8102374

[51] Int. Cl.[3] ..... B65B 63/02; B65B 1/24

[52] U.S. Cl. ..... 53/530; 53/258; 53/261

[58] Field of Search ..... 53/530, 529, 572, 258, 53/255, 571, 573, 260, 261

[56] References Cited

U.S. PATENT DOCUMENTS

| | | | |
|---|---|---|---|
| 3,254,472 | 2/1962 | Clark et al. . | |
| 3,803,799 | 4/1974 | Mosterd | 53/258 X |
| 4,033,088 | 7/1977 | Markert | 53/572 X |
| 4,147,012 | 4/1979 | Van Mil | 53/572 X |
| 4,352,263 | 10/1982 | Andrews, Jr. | 53/258 X |
| 4,377,929 | 3/1983 | Altenpohl et al. | 53/572 |

FOREIGN PATENT DOCUMENTS

| | | |
|---|---|---|
| 1525559 | 8/1974 | United Kingdom . |
| 1597193 | 3/1978 | United Kingdom . |

*Primary Examiner*—Horace M. Culver
*Attorney, Agent, or Firm*—Larson and Taylor

[57] ABSTRACT

A device for packing poultry with means (7) for supporting an opened bag (9) and means (12,13) for pushing a fowl into said bag, a pushing member (12) having a vertical central baffle (26) oriented in the pushing direction to guide the legs of the fowl in order to prevent a twisting movement of the pushed fowl, which otherwise at times could happen and provoke irregularity or even disturb of the pushing operation.

8 Claims, 8 Drawing Figures

DEVICE FOR PACKING A FOWL

The invention relates to a device for packing a fowl, provided with a dressing passage and one or more pushing members for pushing the fowl through said pressing passage, one of which is adapted to engage the ends of the legs and to push them against the body.

Such a device is known from the U.S. Pat. No. 4,147,012.

The invention aims to counter as far as possible irregularities which occur when pushing the fowl, specially its legs. Specifically, the case may occur that the fowl twists more or less when being pushed, which may cause it to take an oblique or wrong position, so that further packing becomes difficult and even a packing machine may become disoriented or have to be switched off.

The invention aims to provide in a simple way that the fowl, when its legs are pushed, will be pushed straight forward into the bag with a considerably higher certainty.

Accordingly it is provided according to the invention, that a central baffle is present, at both sides of which the said pushing member is adapted to push the ends of the legs.

When applying the invention in the case when a further pushing member is present, as is known per se from the cited U.S. Pat. No. 4,147,012, it is advantageously provided that the baffle is part of this further pushing member for pushing the fowl into the bag.

Therewith the correct position of the legs obtained with the invention can be taken advantage of by providing that the front side of the further pushing member is located at a distance from the lower side of the said dressing passage. By this feature the further pushing member will generally push the upper parts of the legs as well as the body of the fowl and do this relatively straight on, so that by reason of the further determination of the location of the ends of the legs practically no disturbancy has to be considered.

Specially it can be provided therewith that the further pushing member has a pushing surface oriented transverse to the direction of movement of the pushing member and located at some distance behind its front side. This pushing surface will evenly shift foward the body of the fowl below the upper parts of the legs, whereby also advantage is taken of the fact that the legs with their ends are received at a relatively high level, so that space for the driving element is available.

Accordingly it is preferably provided that the central baffle is mounted to a support surface for the legs and perpendicular to said surface. Such a support surface, on which the legs can simply be laid down, has already with a simple straight front edge a sufficient holding capability for the fowl and the upper part of the legs, whereas sufficient space is available there below for the pushing surface.

When applying the invention it is preferably provided that said one pushing member is provided with a slit for receiving the central baffle.

In the following the invention is further described with reference to the drawings, in which.

Figure 2:
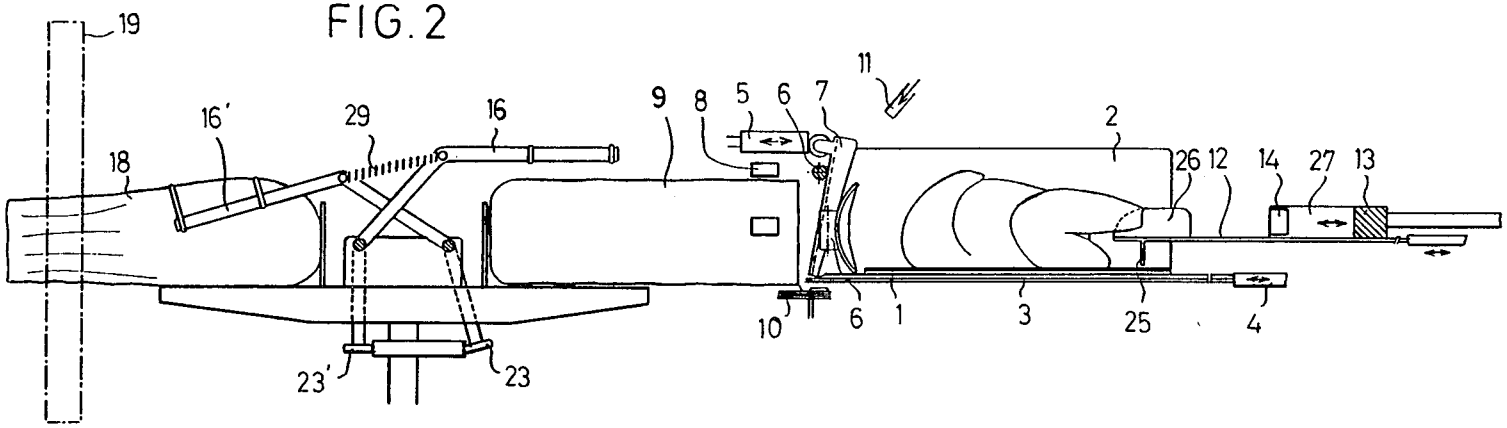
FIG. 2 is a side view of the invention in the starting position.
Figure 3:
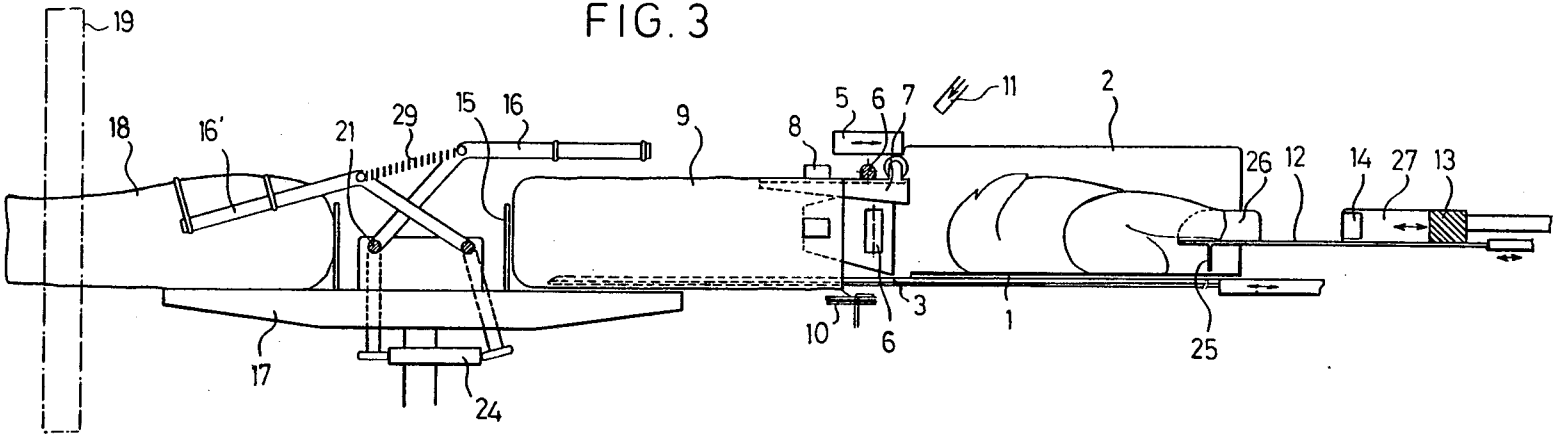
Figure 4:
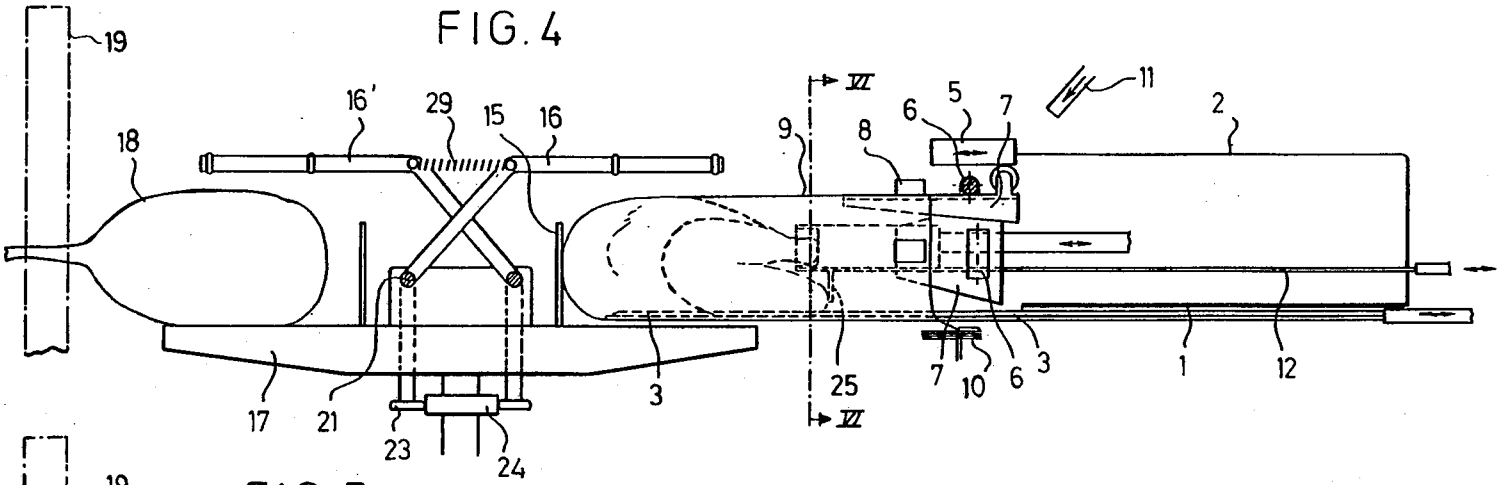
Figure 5:
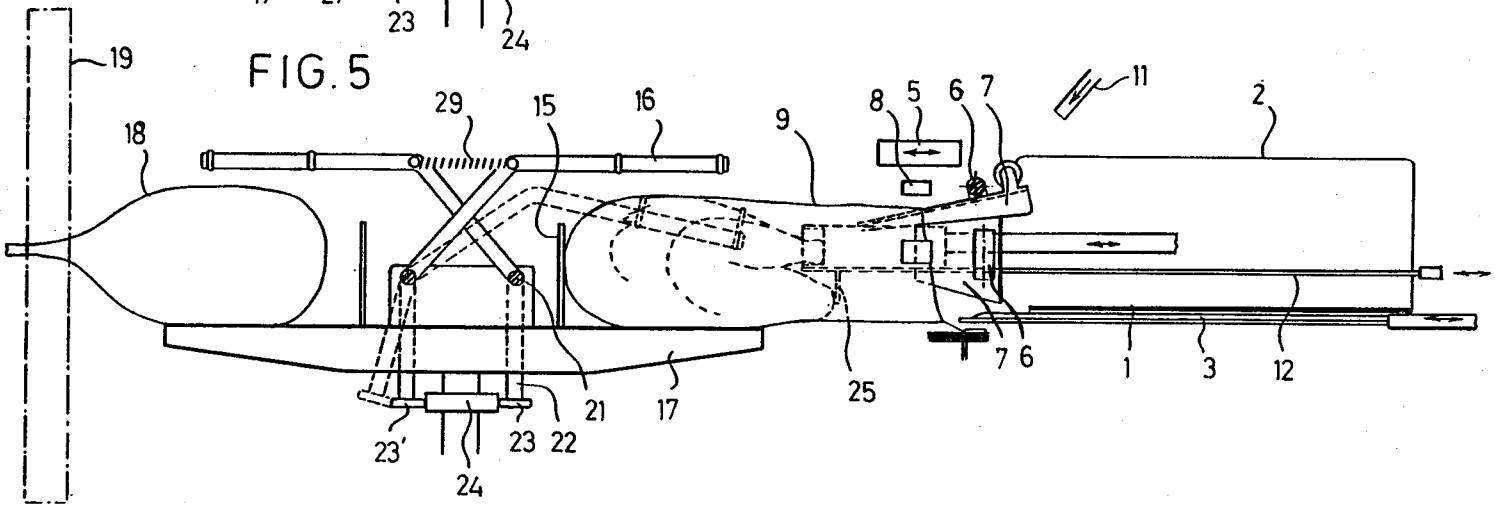
Figure 6:
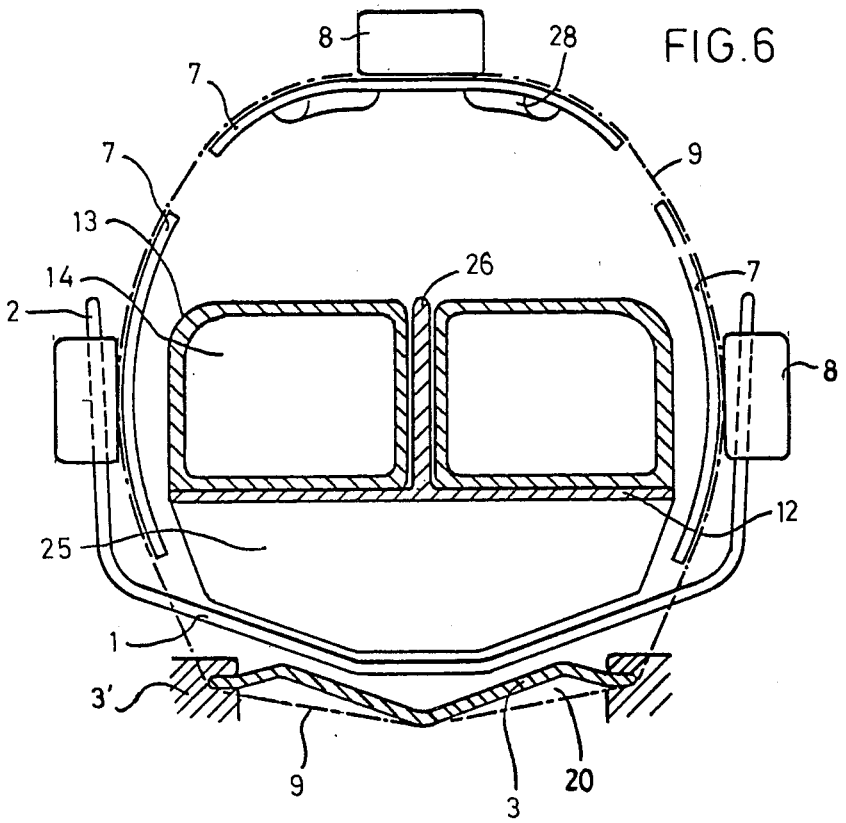
Figure 7:
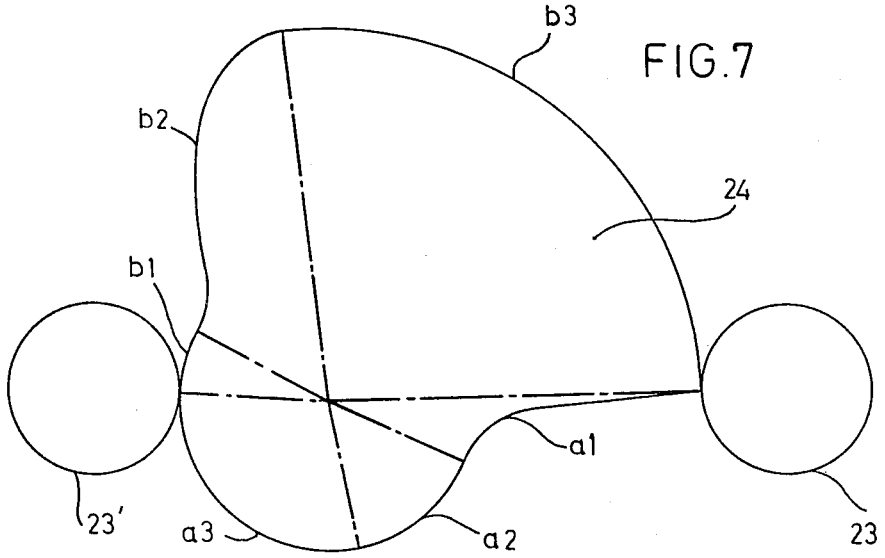

FIG. 3 corresponds to FIG. 2 but shows a further stage;

FIG. 4 shows a still further stage in the same manner as FIGS. 2 and 3;

FIG. 5 shows a still further stage;

FIG. 6 schematically shows a cross-section taken along line VI—VI of FIG. 4;

FIG. 7 serves to illustrate a control cam; and

Figure 8:
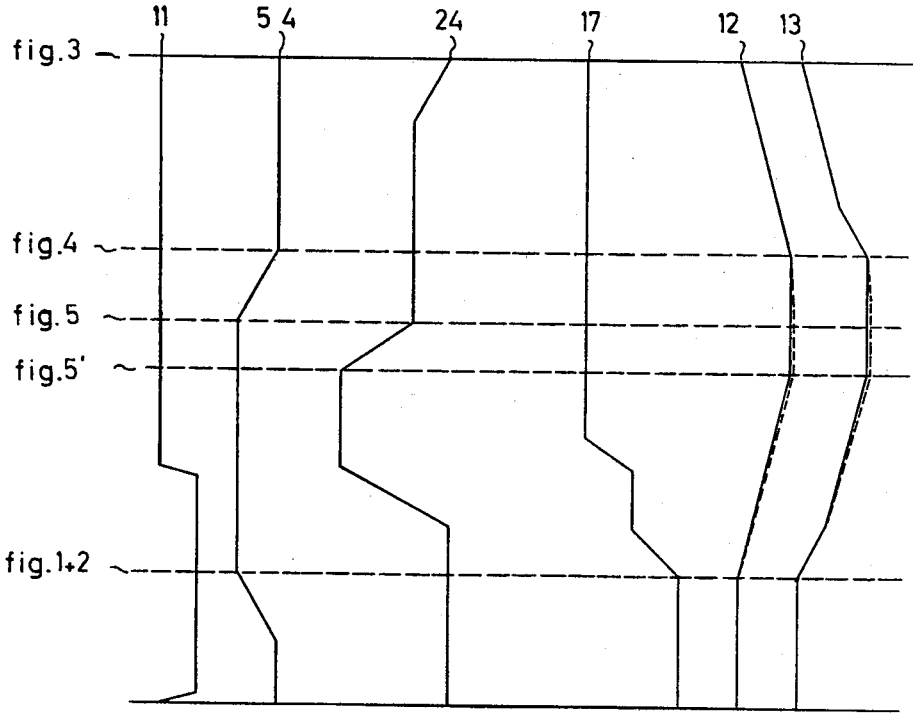

FIG. 8 shows a number of graphs in which the workings of several parts of the invention are shown in mutual correlation.

In the drawings reference numeral 1 indicates a deposit gutter having slightly converging vertical walls 2 and centrally below its bottom a bottom plate 3 movable in its longitudinal direction. As more specifically and schematically shown in FIGS. 2–5 inclusive the bottom plate 3 can be moved by a driving member 4, which is for instance a pneumatic cylinder, and which has not been further detailed in the drawing.

In FIG. 6 the cross-sectional shape of the deposit gutter 1 and the bottom plate 3 as well as a guide 3' in which the bottom plate 3 is guided, are shown.

Each driving member 5, three of which are shown, serves to actuate the three bag stretch members 7. Each bag stretch member 7 is formed as a pivotable plate having a pivot shaft 6 and is pivotable from the position shown in FIGS. 1 and 2 into the position shown in FIG. 3, in which each of them clamps a bag 9 between itself and a fixedly mounted counter member 8.

The bag 9 is the uppermost of a stack 10 of bags which, by means of pressurized air from a nozzle 11, is brought to the illustrated position and therein fixed by the stretching members 7.

Synchronous with the actuation of the driving members 5 for the stretching members 7 also the driving member 4 for the bottom plate 3 is operated, so that the bottom plate 3 takes the position shown in FIG. 3.

Following this the pushing members 12 and 13 which are movable in the longitudinal direction of the bag become active. This can be carried out pneumatically, whereby the member 12 presses against the body of the fowl. The pushing member 12 consists of a horizontal plate having at its lower side somewhat retracted a transverse plate 25 and at its upper side in the middle a vertical baffle 26 extending in the longitudinal direction. The member 13 has at its front side two recesses 14, by reason of which this member 13 is adapted to push the legs of the fowl and to lay them against the body of the fowl. A slit 27 in the member 13 accommodates the baffle 26.

As more specifically appears from FIG. 4 the members 12 and 13 are completely shifted into the bag as the bag is supported on its side by an abutment member 15. Therewith the bottom plate 3 is retracted, so that the position of FIG. 5 comes to existence. In this position a retaining member 16 is pressed onto the fowl, as has been shown in interrupted lines in FIG. 5, the fowl being supported by a turntable 17. After this the turntable 17 is rotated until the bag with the fowl is in the position indicated by reference numeral 18 in which position the bag is closed by a closing device 19 which has not further been detailed.

An important advantage of this construction is, that the time necessary for stretching and filling of a bag forms a first cycle and the time necessary for closing the bag a second one, which increases the working speed of the complete device to a considerable extent.

Figure 1:
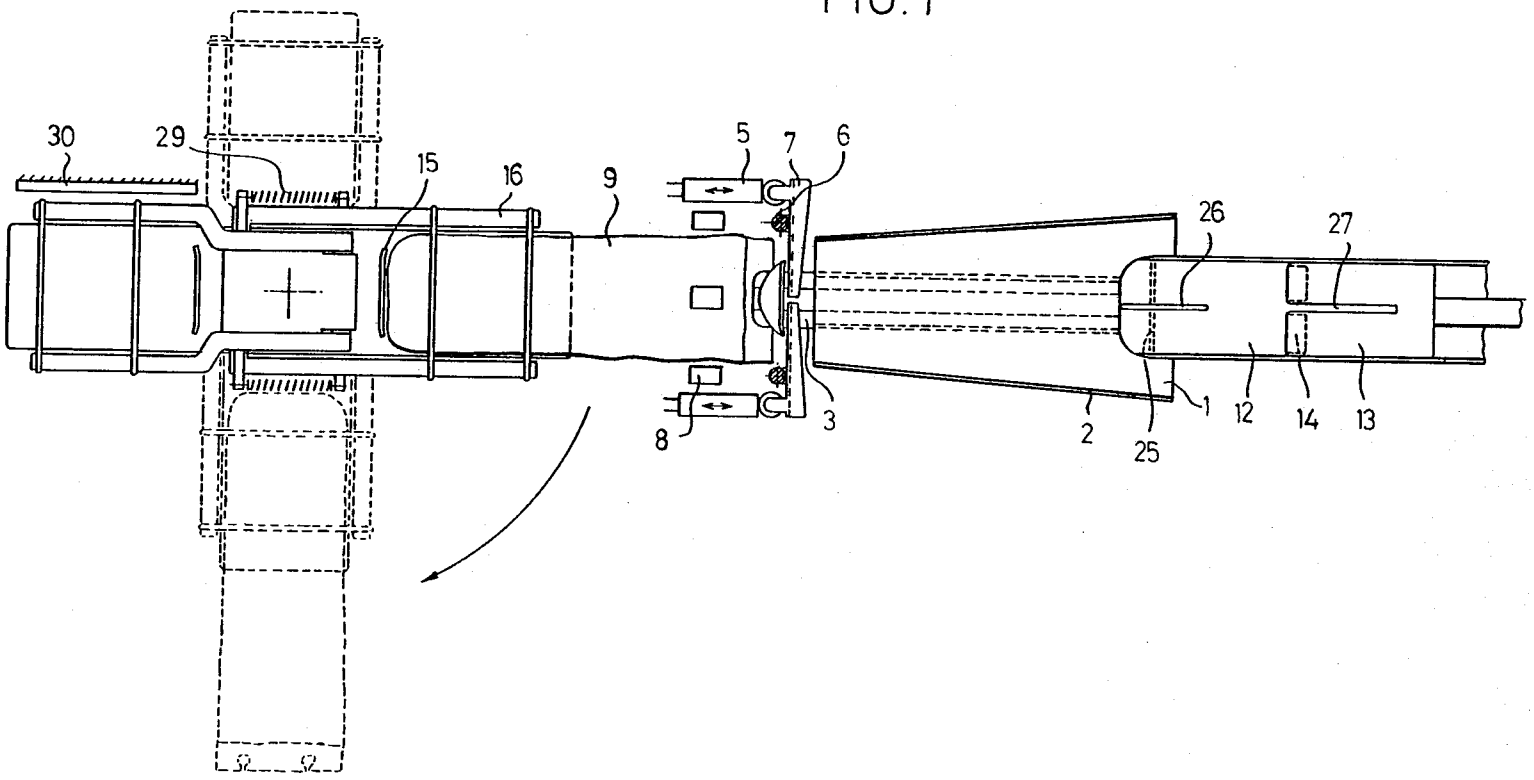
FIG. 1 shows a plan view of the invention in the starting position.

A further advantage of the illustrated construction is, that the air blowing from the nozzle 11 can bring a bag of the stack of bags into the position desired for stretching, whereby this happens at the moment that the turntable 17 is in the position shown with interrupted lines in FIG. 1, so that the advantage is obtained that the bag is not hampered by the turntable when bringing the bag to the desired position, after which, when the turntable is in the position shown in solid lines in FIG. 1, it can serve the purpose of supporting the bag and the fowl when the bottom plate has been retracted therefrom.

In FIG. 6 a cross-section through the bottom plate 3 has been shown, whereby it is visible that between this plate and the bag 9 two passage gutters 20 for air are present at the lower side. This means that when the fowl is shifted over the bottom plate into the bag the air from the front side of the bag can always easily be vented through the gutters 20, whereas nevertheless, after the plate 3 has been retracted, a good tight enclosure of the bag around the fowl can be realized. The stretching members 7 are also schematically shown in FIG. 6 as well as the counter members 8 and the pushing members 12, 25, 26 and 13, 14. Further, it is visible that the uppermost stretch member 7 at its inner side has guiding ribs 28.

By rotating a control cam 24 the brackets 16 and 16' are actuated because they are connected via rotating shafts 21 to actuating arms 22, and have, at their ends follow rollers 23' and 23 cooperating with said cam 24. Tension springs 29 keep the follow rollers 23 and 23' in engagement with the cam 24.

The follow rollers 23 and 23' and the cam 24 have been shown again in FIG. 7. Therein the cam has been shown in the position of FIG. 3 of the drawing. This cam has a control member (not-shown) which can cause it to rotate. With a first rotational movement the cam moves 30° counter clockwise by reason of which follow roller 23 swings inwardly over the cam part a1, so that bracket 16' (see FIG. 2) moves from the position of FIG. 3 into that of FIG. 4.

Therewith follow roller 23' runs over cam part b1 of cam 24 and consequently the related bracket 16 is not swung, in. The mutual position of the cam and follow rollers is maintained until the position of FIG. 5 is reached, thus the fowl being completely shifted forward and the bottom plate 3 retracted, whereby the stretching members 7 are still kept in their opened position by the pushing member 13. Now the cam 24 is rotated 60° further counter clockwise. Then the follow roller 23 cooperates with the part a2 of the cam 24, during which time no variation in radius occurs and consequently no swinging movement of the related bracket. The follow roller 23' runs over cam part b2 which has an increase of radius, so that the corresponding bracket 16 is swung downward. Now the turntable 17 is rotated over 90°, during which time the follow roller 23' runs over cam part b3 and follow roller 23 over cam part a3. None of these cam parts show a variation of radius, so that no swinging movement occurs. After this the cam is rotated 90° clockwise, by reason of which follow roller 23 runs over cam part a3 but now in the opposite direction, and follow roller 23' runs over cam part b3, but also in the opposite direction. Following this the table rotates still 90° further, so that the starting position is taken reached, but with exchange of the brackets and follow rollers 16, 16' and 23' and 23, respectively.

The operation of the device is further explained below with reference to the time graphs of FIG. 8. In this figure the vertical axis is the time axis, against which, as a reference the positions of the several figures are indicated and wherein the graph indicates the reference numerals of the parts to which these graphs relate. These are the nozzle 11, actuating members 5 and 4 which are always actuated together; the cam 24; the turntable 17 and the pushing members 12 and 13.

In FIG. 8 is started from the position of FIG. 3, because in that position depositing of a fowl in the deposit gutter 1 occurs. After this an actuating mechanism is activated by reason of which a complete cycle is carried out until the position of FIG. 3 is reached again.

Depositing a fowl need not happen with special care, provided the ends of the legs are located at both sides of the baffle 26 on the horizontal plate of the pushing member 12 and the fowl further is located such that its brestbone comes between the guide ribs 28.

After starting the device the pushing members 12 and 13 are shifted toward the left, wherein initially they move equally but the pushing member 13 receives at the end of its stroke a higher velocity and overtakes the pushing member 12 until the position of FIG. 4 is attained, in which the front edges of the pushing members 12 and 13 almost coincide.

Because the front edge of 12 is located on a certain height, in practice some cm above the deposit gutter, this edge engages the back side of the upper parts of the legs and the body of the fowl. In combination with the baffle 26, this causes the fowl to be pushed straight forward, which cause is also enhanced by the vertical plate 25.

The final position of the pushing members 12 and 13 has to be such, that a good dressing of the bird is obtained, e.g. for chickens it is generally preferred that the ends of the legs are located near the front edge of the pushing member 12. This may, however, be different for other types of fowl.

When starting the device the cam 24 is rotated 30° counter clockwise, by reason of which the retaining member 16' swings upwardly into the position of FIG. 4. After attaining the position of FIG. 4 the actuating members 5 are retracted and the stretching members 7 can swing back, during which time, however, the pushing members 12 and 13 are prevented from swinging completely back into the position of FIGS. 1 and 2.

At the same time the driving member 4 and consequently the bottom plate 3 are retracted, by reason of which some room in the bag is created and the pushing members 12 and 13 can move a little further on. The graph for these members will in that instance be located anywhere between the solid and the interrupted lines 12 and 13 in FIG. 8.

Starting from the position of FIG. 5 the cam 24 is rotated 60° counter clockwise, so that the retaining member 16 takes the position indicated with interrupted lines. The end of this movement is indicated in FIG. 8 with FIG. 5'. Now retracting of the pushing members 12 and 13 begins. When they are sufficiently retracted to enable rotation of table 17 without too strong a hindrance caused by the pushing members 12 or 13 and/or the stretching members kept open by them, the table 17 is rotated a quarter of a revolution as follows from line 17 in FIG. 8. Therewith the preceding bag 18, which has been closed by a closing device 19, shown only schematically engages an abutment and wipe off member 30 and falls from the table 17. With this rotational movement of the table 17 the bag 9 is retained by bracket 16. After this rotational movement over 90°, during which time the bag is torn away from the bag stack 10, as is known per se, the nozzle 11 becomes active. After this the next bag of the stack 10 is brought into the position of the bag 9 in FIGS. 1 and 2, whereby the table 17 rotated over a quarter of a revolution does not hinder the bag.

After the first movement of the turntable 17 the cam 24 rotates 90° clockwise, (see graph 24). This does not cause any positional change of the retaining members 16 and 16'.

Following this the turntable 17 rotates again 90°, whereby as has been explained earlier with reference to FIG. 7 again no positional change of the retaining members 16 and 16' occurs. In the meantime the pushing members 12 and 13 have arrived in their retracted positions, whereby it will be clear that the accelerated movement of 13 indicated in FIG. 8 in the final part of its back stroke is not necessary: each movement with which 12 and 13 are in time in their starting positions is allowable.

Now the device is in the position of FIGS. 1 and 2, but with a rotation of the turntable over 180°. Now the next fowl can be deposited into the deposit gutter and after activation of the actuating mechanism the whole cycle will be repeated.

What we claim is:

1. In a device for packing a fowl the improvement comprising:

means for defining a deposit location for receiving the fowl and a dressing passage through which the fowl is pushed in a longitudinal direction from the deposit location, a central baffle mounted centrally in the deposit location and extending in the longitudinal direction and positioned such that when a fowl is placed in the deposit location, the legs of the fowl will be positioned one on each side of the baffle, said baffle being movable from said position in the deposit location toward the dressing passage, a pushing member having a foward end comprising engaging means for engaging the ends of both legs of a fowl which has been placed in the deposit location, said pushing member being movable from a first position, whereat it is spaced sufficiently far from the dressing passage that it is free from engagement with a fowl originally placed onto the deposit location, to a second position whereat said engaging means engages the ends of both legs of the fowl while the baffle continues to separate the legs from each other, to a third position whereat the pushing member pushes the fowl through the dressing passage, said baffle being movable along with the pushing member at least from said second position to said third position.

2. A device according to claim 1, in which the baffle is part of a further pushing member having a supporting surface extending laterally on both sides of said baffle.

3. A device according to claim 2, wherein the front edge of the further pushing member is located at a distance above the bottom of the said dressing passage and deposit location.

4. A device according to claim 3, including a plate, the front edge of the further pushing member comprising the forward edge of said plate, said plate comprising an additional pushing surface oriented transverse to the said longitudinal direction and extending from the plate downwardly toward the bottom of the dressing passage and deposit location, said additional pushing surface being located at a distance behind the said forward edge, taken in the said longitudinal direction.

5. A device according to claim 1, including a lower surface extending in the said longitudinal direction for bearing the fowl's body and a supporting surface for supporting the fowl's legs when the pushing member is in the said first position, said central baffle being mounted to said supporting surface.

6. A device according to claim 1, in which said pushing member is provided with a slit for receiving the central baffle.

7. A device according to claim 1, in which said engaging means comprises two recesses formed in a pushing surface of the pushing member, said recesses being located one on each side of said baffle and at the same height above the bottom of the dressing passage and deposit location.

8. A device according to claim 2, wherein at said third position, both the first and the further pushing means are located in generally the same transverse plane.

* * * * *

UNITED STATES PATENT AND TRADEMARK OFFICE

CERTIFICATE OF CORRECTION

PATENT NO. : 4,464,882

DATED : August 14, 1984

INVENTOR(S) : Van Ginkel et al

It is certified that error appears in the above-identified patent and that said Letters Patent is hereby corrected as shown below:

In the cover page of the patent, item [73] after "Assignee:" please delete "Moba Holdings, Bareveld B.V., Netherlands" and substitute therefor --ADMINISTRATIE - EN AUTOMATISERINGSCENTRUM VULCAAN B.V., Amsterlveen, Netherlands--

Signed and Sealed this

*Second* Day of *April 1985*

[SEAL]

*Attest:*

DONALD J. QUIGG

*Attesting Officer*

*Acting Commissioner of Patents and Trademarks*